US012140347B2

(12) United States Patent
Hirayama et al.

(10) Patent No.: US 12,140,347 B2
(45) Date of Patent: Nov. 12, 2024

(54) ROTARY COMPRESSOR AND REFRIGERATION CYCLE DEVICE

(71) Applicant: Carrier Japan Corporation, Tokyo (JP)

(72) Inventors: Takuya Hirayama, Fuji (JP); Isao Kawabe, Fuji (JP); Taishi Nagahata, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 183 days.

(21) Appl. No.: 17/819,020

(22) Filed: Aug. 11, 2022

(65) Prior Publication Data

US 2022/0390153 A1 Dec. 8, 2022

Related U.S. Application Data

(63) Continuation of application No. PCT/JP2020/007348, filed on Feb. 25, 2020.

(51) Int. Cl.
*F25B 31/02* (2006.01)
*F04C 23/00* (2006.01)

(52) U.S. Cl.
CPC ..... *F25B 31/026* (2013.01); *F04C 23/008* (2013.01)

(58) Field of Classification Search
CPC ..... F04C 18/3564; F04C 2230/605; F04C 2240/60; F04C 2240/807; F04C 2270/12; F04C 23/001; F04C 23/008; F04C 29/0057; F25B 31/026
See application file for complete search history.

(56) References Cited

U.S. PATENT DOCUMENTS

2014/0227117 A1 8/2014 Uekawa

FOREIGN PATENT DOCUMENTS

| | | | |
|---|---|---|---|
| CN | 103452844 | A | 12/2013 |
| CN | 104728118 | A | 6/2015 |
| CN | 104838145 | A | 8/2015 |
| CN | 204532830 | U | 8/2015 |
| CN | 206299566 | U | 7/2017 |

(Continued)

OTHER PUBLICATIONS

Combined Chinese Office Action and Search Report issued Jan. 4, 2024 in Chinese Patent Application No. 202080076436.2 (with English Translation of Office Action only), 9 pages.

(Continued)

*Primary Examiner* — Anthony Ayala Delgado
(74) *Attorney, Agent, or Firm* — Oblon, McClelland, Maier & Neustadt, L.L.P.

(57) ABSTRACT

A rotary compressor according to an embodiment includes a plurality of eccentric parts, a first balancer, and a second balancer. The plurality of eccentric parts include a first eccentric part, a second eccentric part, and a third eccentric part disposed to be aligned from one side to the other side. The second balancer is disposed on the other side of the first balancer. Angles between a direction of eccentricity of the first balancer and directions of eccentricity of the plurality of eccentric parts are configured to increase in an order of the third eccentric part, the second eccentric part, and the first eccentric part. Angles between a direction of eccentricity of the second balancer and directions of eccentricity of the plurality of eccentric parts are configured to increase in an order of the first eccentric part, the second eccentric part, and the third eccentric part.

6 Claims, 9 Drawing Sheets

(56) References Cited

FOREIGN PATENT DOCUMENTS

| | | | |
|---|---|---|---|
| JP | 5-187374 | A | 7/1993 |
| JP | 6-10863 | A | 1/1994 |
| JP | 2004-270654 | A | 9/2004 |
| JP | 2008-63973 | A | 3/2008 |
| JP | 2014-129755 | A | 7/2014 |
| KR | 1998-073118 | A | 11/1998 |
| WO | WO 2019/171540 | A1 | 9/2019 |
| WO | WO 2019/186695 | A1 | 10/2019 |

OTHER PUBLICATIONS

Extended European Search Report issued on Oct. 11, 2023 in European Patent Application No. 20921005.3, 6 pages.
International Search Report issued Apr. 28, 2020 in PCT/JP2020/007348, filed on Feb. 25, 2020, 4 pages (with English translation).
Combined Chinese Office Action and Search Report issued May 22, 2024 in Chinese Patent Application No. 202080076436.2 (with English translation), 8 pages.

ROTARY COMPRESSOR AND REFRIGERATION CYCLE DEVICE

CROSS-REFERENCE TO RELATED APPLICATIONS

This is a Continuation Application of International Application No. PCT/JP2020/007348, filed on Feb. 25, 2020; the entire contents of which are incorporated herein by reference.

FIELD

Embodiments described herein relate generally to a rotary compressor and a refrigeration cycle device.

BACKGROUND

In a refrigeration cycle device, a multi-cylinder rotary compressor having high compression performance is utilized. A multi-cylinder rotary compressor includes a plurality of compression mechanism units, a shaft, and a plurality of eccentric parts. The plurality of eccentric parts are provided on the shaft and are disposed in each of the plurality of compression mechanism units. Directions of eccentricity of the plurality of eccentric parts differ in a circumferential direction of the shaft. When the plurality of eccentric parts rotate together with the shaft, the rotary compressor vibrates. A rotary compressor in which vibration can be suppressed is required.

DETAILED DESCRIPTION

A rotary compressor according to an embodiment includes a shaft, a plurality of compression mechanism units, a plurality of eccentric parts, a first balancer, and a second balancer. The shaft is rotatable around a central axis. The plurality of compression mechanism units include a first compression mechanism unit, a second compression mechanism unit, and a third compression mechanism unit disposed to be aligned from one side to the other side in a central axis direction of the shaft. The plurality of eccentric parts are provided on the shaft and include a first eccentric part, a second eccentric part, and a third eccentric part disposed in corresponding to the first compression mechanism unit, the second compression mechanism unit, and the third compression mechanism unit. The first balancer rotates together with the shaft. The second balancer is disposed on the other side of the first balancer and rotates together with the shaft.

Angles between a direction of eccentricity of the first balancer with respect to the central axis of the shaft and directions of eccentricity of the plurality of eccentric parts with respect to the central axis of the shaft are configured to increase in an order of the third eccentric part, the second eccentric part, and the first eccentric part. Angles between a direction of eccentricity of the second balancer with respect to the central axis of the shaft and directions of eccentricity of the plurality of eccentric parts with respect to the central axis of the shaft are configured to increase in an order of the first eccentric part, the second eccentric part, and the third eccentric part.

Hereinafter, a rotary compressor and a refrigeration cycle device of an embodiment will be described with reference to the drawings.

Figure 1:
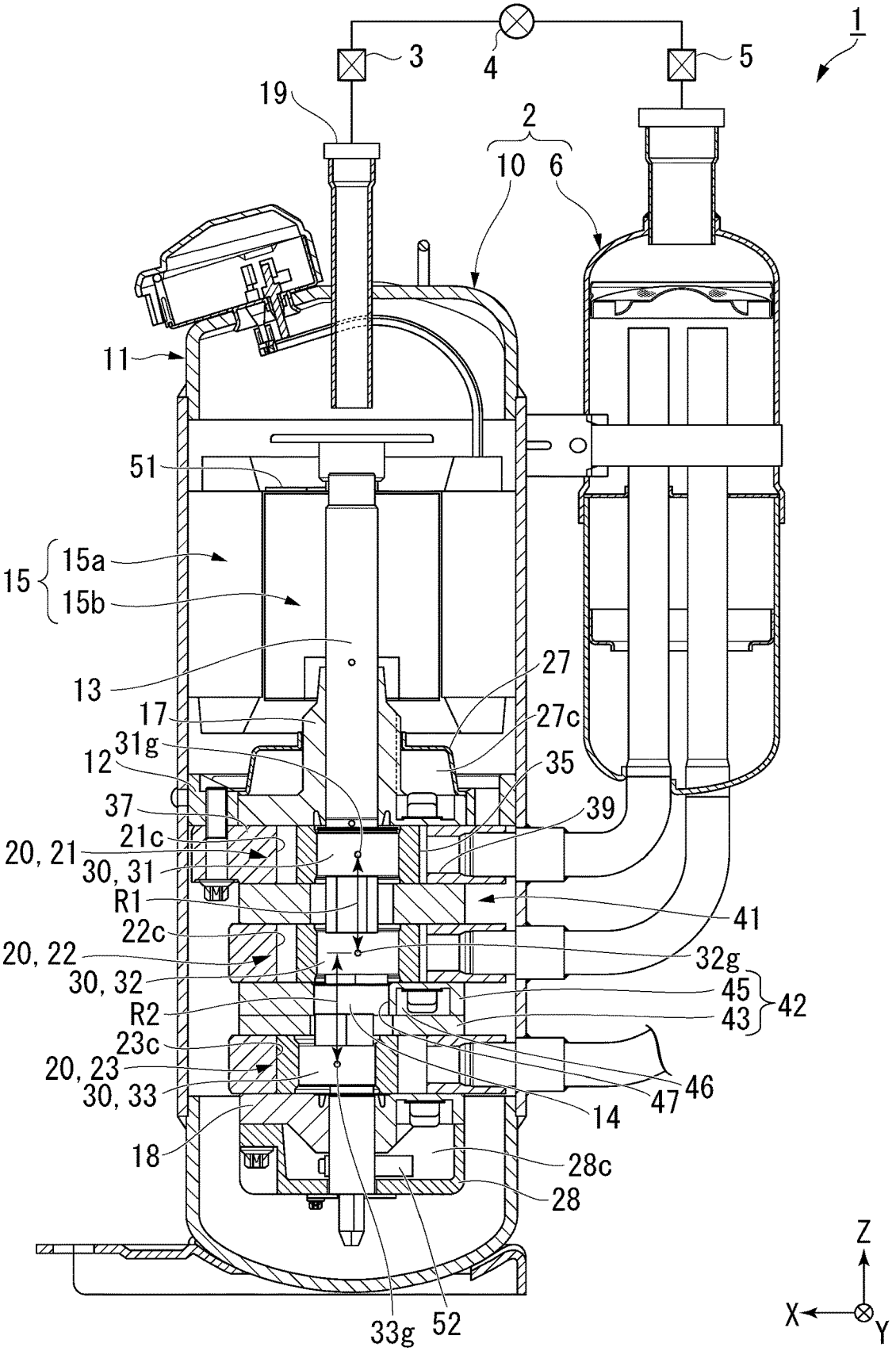
FIG. 1 is a schematic configuration view of a refrigeration cycle device including a cross-sectional view of a rotary compressor according to an embodiment.

FIG. 1 is a schematic configuration view of a refrigeration cycle device including a cross-sectional view of a rotary compressor according to the embodiment. In the present application, a Z direction, an X direction, and a Y direction of an orthogonal coordinate system are defined as follows. The Z direction is a central axis direction of a shaft 13. A +Z direction (one side) is a direction from a compression mechanism unit 20 toward an electric motor unit 15, and a −Z direction (the other side) is a side opposite to the +Z direction. For example, the Z direction is a vertical direction, and the +Z direction is vertically upward. The X direction and the Y direction are radial directions of the shaft 13. The X direction is a direction of eccentricity of a third eccentric part 33 with respect to the central axis of the shaft 13. For example, the X direction and the Y direction are horizontal directions.

A refrigeration cycle device 1 will be briefly described.

The refrigeration cycle device 1 includes a rotary compressor 2, a radiator (for example, a condenser) 3 connected to the rotary compressor 2, an expansion device (for example, an expansion valve) 4 connected to the radiator 3, and a heat absorber (for example, an evaporator) 5 connected to the expansion device 4. The refrigeration cycle device 1 contains a refrigerant such as carbon dioxide (CO2). The refrigerant circulates in the refrigeration cycle device 1 while changing its phase.

The rotary compressor 2 is a so-called rotary type compressor. The rotary compressor 2 compresses a low-pressure gaseous refrigerant (fluid) taken into the inside into a high-temperature and high-pressure gaseous refrigerant. A specific configuration of the rotary compressor 2 will be described later.

The radiator 3 dissipates heat from the high-temperature and high-pressure gaseous refrigerant discharged from the rotary compressor 2 to convert the high-temperature and high-pressure gaseous refrigerant into a high-pressure liquid refrigerant.

The expansion device 4 reduces a pressure of the high-pressure liquid refrigerant sent from the radiator 3 to convert the high-pressure liquid refrigerant into a low-temperature and low-pressure liquid refrigerant.

The heat absorber 5 evaporates the low-temperature and low-pressure liquid refrigerant sent from the expansion device 4 to convert it into a low-pressure gaseous refrigerant. In the heat absorber 5, evaporation of the low-pressure liquid refrigerant takes evaporation heat from the surroundings, and thus the surroundings are cooled. The low-pressure gaseous refrigerant that has passed through the heat absorber 5 is taken into the rotary compressor 2 described above.

As described above, a refrigerant serving as a working fluid circulates while changing its phase between a gaseous refrigerant and a liquid refrigerant in the refrigeration cycle device 1 of the present embodiment. The refrigerant dissipates heat in the process of changing phase from the gaseous refrigerant to the liquid refrigerant and absorbs heat in the process of changing phase from the liquid refrigerant to the gaseous refrigerant. Heating, cooling, or the like is performed by utilizing such heat dissipation and heat absorption.

The rotary compressor 2 will be described.

The rotary compressor 2 includes an accumulator 6 and a compressor main body 10. The accumulator 6 separates the refrigerant sent from the heat absorber 5 into a gaseous refrigerant and a liquid refrigerant. The gaseous refrigerant is taken into the compressor main body 10 through a suction pipe.

The compressor main body 10 includes a case 11, the shaft 13, the electric motor unit 15, and a plurality of compression mechanism units 20.

The case 11 is formed in a cylindrical shape with both end portions closed. The case 11 houses the shaft 13, the electric motor unit 15, and the plurality of compression mechanism units 20. The case 11 includes a discharge unit 19 at an upper end portion. The discharge unit 19 supplies the gaseous refrigerant inside the case 11 to the radiator 3.

The shaft 13 is disposed along the central axis of the compressor main body 10. The shaft 13 includes a plurality of eccentric parts 30. Details of the plurality of eccentric parts 30 will be described later.

The electric motor unit 15 is disposed in the +Z direction of the shaft 13. The electric motor unit 15 includes a stator 15*a* and a rotor 15*b*. The stator 15*a* is fixed to an inner circumferential surface of the case 11. The rotor 15*b* is fixed to an outer circumferential surface of the shaft 13. The electric motor unit 15 rotationally drives the shaft 13.

The plurality of compression mechanism units 20 compress the gaseous refrigerant by rotation of the shaft 13. The plurality of compression mechanism units 20 are disposed in the −Z direction of the shaft 13. The plurality of compression mechanism units 20 include a set of three compression mechanism units 20 including a first compression mechanism unit 21, a second compression mechanism unit 22, and a third compression mechanism unit 23. The first compression mechanism unit 21, the second compression mechanism unit 22, and the third compression mechanism unit 23 are disposed to be aligned in that order from the +Z direction to the −Z direction. Hereinafter, a configuration of the first compression mechanism unit 21 will be described as a representative. Configurations of the second compression mechanism unit 22 and the third compression mechanism unit 23 are the same as that of the first compression mechanism unit 21 except for a direction of eccentricity of the eccentric parts 30.

The first compression mechanism unit 21 includes a first eccentric part 31, a roller 35, and a cylinder 37.

The first eccentric part 31 has a columnar shape and is integrally formed with the shaft 13. When viewed from the +Z direction, a center of the first eccentric part 31 is eccentric from the central axis of the shaft 13.

The roller 35 is formed in a cylindrical shape and is disposed along an outer circumference of the first eccentric part 31.

The cylinder 37 is fixed to a frame 12. An outer circumferential surface of the frame 12 is fixed to an inner circumferential surface of the case 11. The cylinder 37 includes a first cylinder chamber 21*c*, a vane (not illustrated), and a suction hole 39. The first cylinder chamber 21*c* is formed to penetrate a center of the cylinder 37 in the Z direction. The first cylinder chamber 21*c* houses the first eccentric part 31 and the roller 35 therein. The vane is housed in a vane groove formed in the cylinder 37 and can advance into and retreat from the inside of the first cylinder chamber 21*c*. The vane is urged so that a distal end portion thereof is brought into contact with an outer circumferential surface of the roller 35. The vane, together with the first eccentric part 31 and the roller 35, partitions the inside of the first cylinder chamber 21*c* into a suction chamber and a compression chamber. The suction hole 39 takes the gaseous refrigerant into the suction chamber of the first cylinder chamber 21*c* from the accumulator 6.

The rotary compressor 2 includes a first bearing 17, a second bearing 18, a first partition part 41, a second partition part 42, a first muffler 27, and a second muffler 28.

The first bearing 17 is disposed in the +Z direction of the plurality of compression mechanism units 20 and supports the shaft 13. The second bearing 18 is disposed in the −Z direction of the plurality of compression mechanism units 20 and supports the shaft 13.

The first partition part 41 is disposed between the first compression mechanism unit 21 and the second compression mechanism unit 22. The second partition part 42 is disposed between the second compression mechanism unit 22 and the third compression mechanism unit 23.

The first muffler 27 forms a first muffler chamber 27*c* between itself and the first bearing 17. The gaseous refrigerant compressed by the first compression mechanism unit 21 is discharged to the first muffler chamber 27*c*. The gaseous refrigerant discharged to the first muffler chamber 27*c* is discharged to the inside of the case 11.

The second muffler 28 forms a second muffler chamber 28*c* between itself and the second bearing 18. The gaseous refrigerant compressed by the third compression mechanism unit 23 is discharged to the second muffler chamber 28*c*. The second muffler chamber 28*c* communicates with the first muffler chamber 27*c* via a passage between muffler chambers (not illustrated).

The gaseous refrigerant compressed by the second compression mechanism unit 22 is discharged to a partition part passage 46 formed in the second partition part 42. The partition part passage 46 communicates with the passage between the muffler chambers described above.

A region between a center of gravity 31g of the first eccentric part 31 and a center of gravity 32g of the second eccentric part 32 is a first region R1. A region between the center of gravity 32g of the second eccentric part 32 and a center of gravity 33g of the third eccentric part 33 is a second region R2. A distance of the second region R2 in the Z direction is larger than a distance of the first region R1 in the Z direction. An intermediate bearing 45 that supports the shaft 13 is disposed in the second region R2. The second partition part 42 described above is disposed in the second region R2. The second partition part 42 includes a partition member 43 and the intermediate bearing 45. The partition member 43 is disposed in the −Z direction, and the intermediate bearing 45 is disposed in the +Z direction. An enlarged diameter part 14 of the shaft 13 is formed at a position in the Z direction at which the intermediate bearing 45 is disposed. A through hole 47 formed at a center of the intermediate bearing 45 supports the enlarged diameter part 14 of the shaft 13.

The plurality of compression mechanism units 20 are disposed between the first bearing 17 and the second bearing 18. Bending of the shaft 13 increases between the first bearing 17 and the second bearing 18. The intermediate bearing 45 is disposed near a center of the plurality of compression mechanism units 20 in the Z direction. The intermediate bearing 45 suppresses the bending of the shaft 13. Thereby, the rotary compressor 2 having low vibration, high reliability, and high performance can be provided.

The plurality of eccentric parts 30 will be described.

The plurality of eccentric parts 30 include the first eccentric part 31, the second eccentric part 32, and the third eccentric part 33. The first eccentric part 31, the second eccentric part 32, and the third eccentric part 33 are disposed in the first compression mechanism unit 21, the second compression mechanism unit 22, and the third compression mechanism unit 23, respectively.

Figure 2:
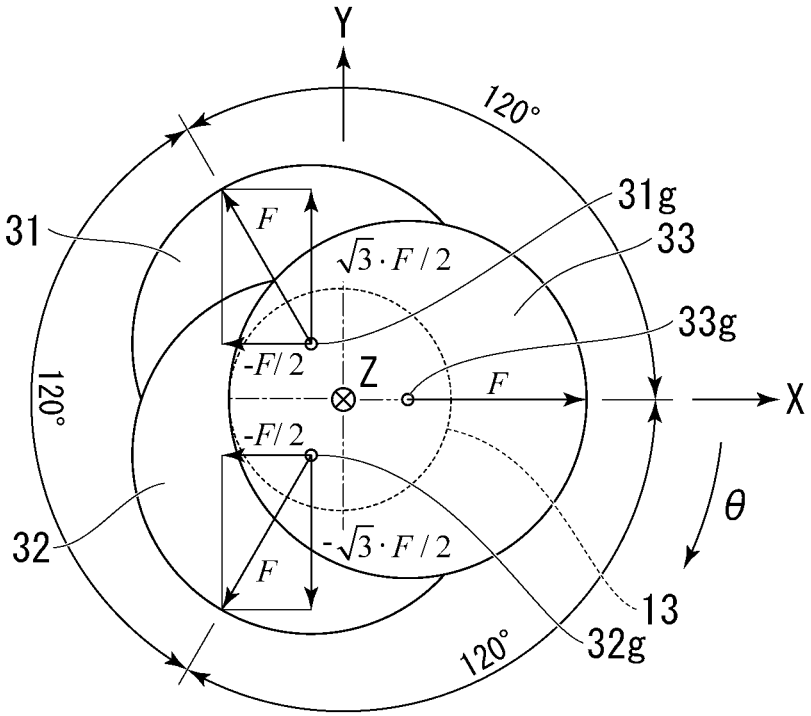
FIG. 2 is a bottom view of a plurality of eccentric parts.

FIG. 2 is a bottom view of the plurality of eccentric parts. The plurality of eccentric parts 30 are eccentric with respect to the central axis of the shaft 13. Directions of eccentricity of the plurality of eccentric parts 30 are different from each other in a circumferential direction of the shaft 13. It is desirable that the directions of eccentricity of the plurality of eccentric parts 30 be at equiangular intervals in the circumferential direction of the shaft 13. The directions of eccentricity of the first eccentric part 31, the second eccentric part 32, and the third eccentric part 33 are at equiangular intervals of 120° in the circumferential direction of the shaft 13.

In the present application, a θ direction is a rotation direction of a right-hand screw traveling in the +Z direction.

As described above, the direction of eccentricity of the third eccentric part 33 is the X direction. A direction of eccentricity of the second eccentric part 32 is in a direction of 120° in the θ direction from the X direction which is the direction of eccentricity of the third eccentric part 33. A direction of eccentricity of the first eccentric part 31 is in a direction of 120° in the θ direction from the direction of eccentricity of the second eccentric part 32.

When the shaft 13 rotates, a centrifugal force F acts on the centers of gravity of the plurality of eccentric parts 30. Magnitudes of the centrifugal forces F acting on the plurality of eccentric parts 30 are the same. An X-direction component of the centrifugal force acting on the center of gravity 33g of the third eccentric part 33 is F, and a Y-direction component thereof is 0. An X-direction component of the centrifugal force acting on the center of gravity 32g of the second eccentric part 32 is −F/2, and a Y-direction component thereof is $-\sqrt{3}\cdot F/2$. An X-direction component of the centrifugal force acting on the center of gravity 31g of the first eccentric part 31 is −F/2, and a Y-direction component thereof is $\sqrt{3}\cdot F/2$. A moment (swinging moment, rotational moment) of force acts on the shaft 13 due to the centrifugal force F acting on the plurality of eccentric parts 30.

The rotary compressor 2 illustrated in FIG. 1 includes a balancer (counter balancer) that suppresses the moment of force acting on the shaft 13. The rotary compressor 2 includes a first balancer 51 and a second balancer 52. The first balancer 51 and the second balancer 52 rotate together with the shaft 13. The second balancer 52 is disposed in the −Z direction of the first balancer 51. The plurality of eccentric parts 30 are disposed between the first balancer 51 and the second balancer 52 in the Z direction.

The first balancer 51 is disposed in the +Z direction of the plurality of eccentric parts 30. The first balancer 51 is disposed in the +Z direction of the electric motor unit 15. The first balancer 51 is fixed to an end surface of the rotor 15*b* of the electric motor unit 15 in the +Z direction. The first balancer 51 rotates together with the rotor 15*b* and the shaft 13.

The second balancer 52 is disposed in the −Z direction of the plurality of eccentric parts 30. The second balancer 52 is disposed inside the second muffler 28 in the −Z direction of the second bearing 18. The second balancer 52 is formed separately from the shaft 13. The second balancer 52 is fixed to the shaft 13 by a fixing means such as a screw. The second balancer 52 rotates together with the shaft 13.

Figure 3:
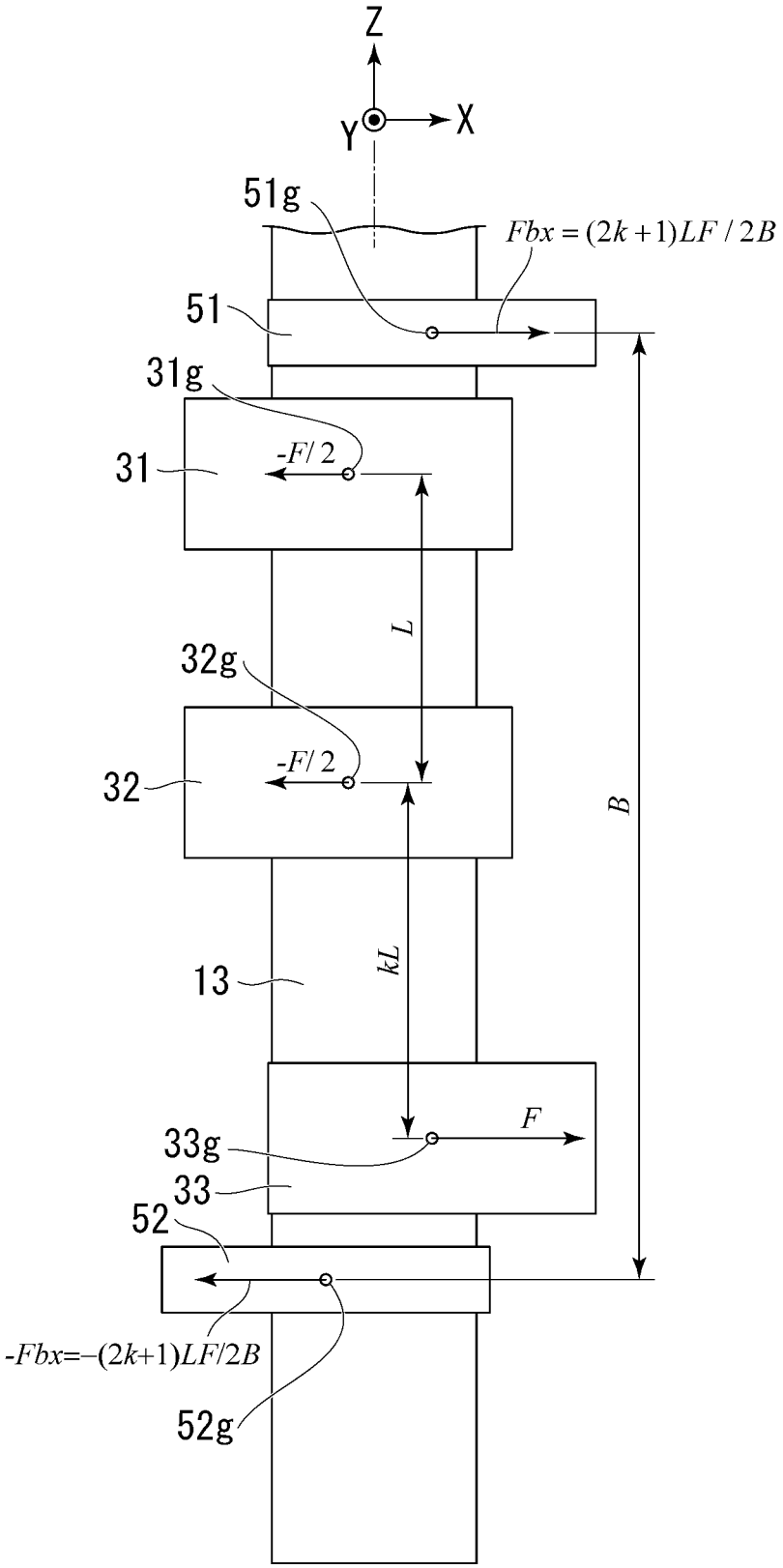
FIG. 3 is a schematic front view of a shaft.
Figure 4:
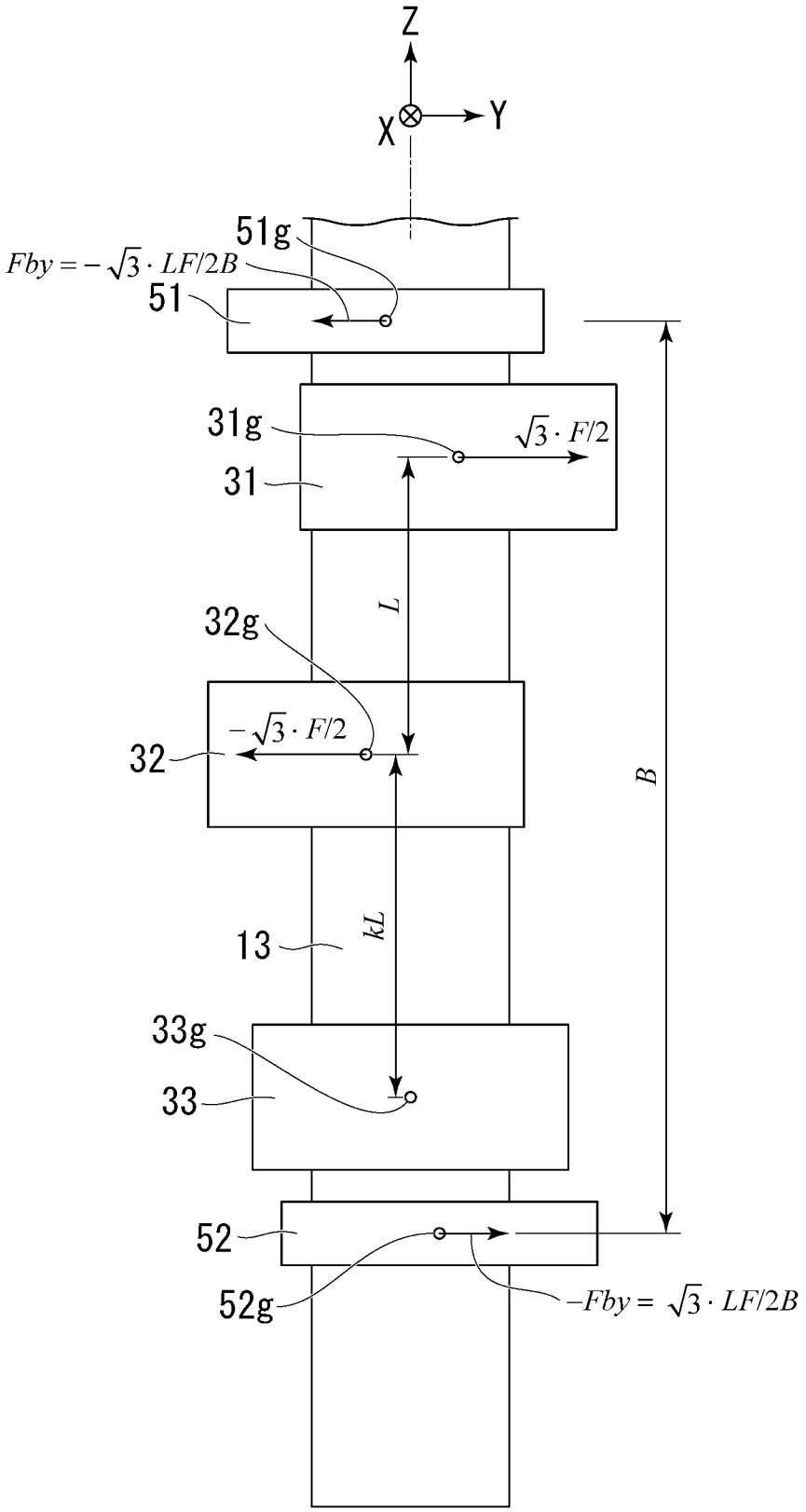
FIG. 4 is a schematic side view of the shaft.

FIG. 3 is a schematic front view of the shaft. FIG. 4 is a schematic side view of the shaft. FIGS. 3 and 4 schematically illustrate shapes and positions of the shaft 13, the first balancer 51, and the second balancer 52 for ease of understanding. A first distance in the Z direction between the center of gravity 31g of the first eccentric part 31 and the center of gravity 32g of the second eccentric part 32 is L. A second distance in the Z direction between the center of gravity 32g of the second eccentric part 32 and the center of gravity 33g of the third eccentric part 33 is kL. k is a ratio of the second distance to the first distance. A distance in the Z direction between a center of gravity 51g of the first balancer 51 and a center of gravity 52g of the second balancer 52 is B.

Using FIG. 3, an X-direction component Fbx of a centrifugal force acting on the first balancer 51, in which a moment of force acting on the shaft 13 around a Y axis is 0, is obtained. For example, the center of gravity 33g of the third eccentric part 33 is used as a reference point. A moment of force My acting on the shaft 13 around the Y axis due to the X-direction component of the centrifugal force F acting on the plurality of eccentric parts 30 is expressed by mathematical expression 1.

$$My=kL\cdot -F/2+(k+1)L\cdot -F/2=-(2k+1)LF/2 \quad (1)$$

For example, the center of gravity 52g of the second balancer 52 is used as a reference point. The X-direction component of the centrifugal force acting on the first balancer 51 due to rotation of the shaft 13 is assumed to be Fbx. A moment of force Mby acting on the shaft 13 around the Y axis due to the X-direction component Fbx of the centrifugal force acting on the first balancer 51 is expressed by mathematical expression 2.

$$Mby=B\cdot Fbx \quad (2)$$

When the following mathematical expression 3 is established, the moment of force acting on the shaft 13 around the Y axis is 0.

$$My+Mby=0 \quad (3)$$

Fbx satisfying mathematical expression 3 is expressed by mathematical expression 4.

$$Fbx=(2k+1)LF/2B \quad (4)$$

A mass, a position, and a shape of the first balancer 51 are set so that the X-direction component Fbx of the centrifugal force acting on the first balancer 51 satisfies mathematical expression 4.

An X-direction component of the centrifugal force acting on the second balancer 52 due to rotation of the shaft 13 is −Fbx. −Fbx is expressed by mathematical expression 5.

$$-Fbx=-(2k+1)LF/2B \quad (5)$$

A mass, a position, and a shape of the second balancer 52 are set so that the X-direction component −Fbx of the centrifugal force acting on the second balancer 52 satisfies mathematical expression 5.

Using FIG. 4, a Y-direction component Fby of the centrifugal force acting on the first balancer 51, in which a moment of force acting on the shaft 13 around an X axis is 0, is obtained. For example, the center of gravity 33g of the third eccentric part 33 is used as a reference point. A moment of force Mx acting on the shaft 13 around the X axis due to the Y-direction component of the centrifugal force F acting on the plurality of eccentric parts 30 is expressed by mathematical expression 6.

$$Mx=kL\cdot-\sqrt{3}\cdot F/2+(k+1)L\cdot\sqrt{3}\cdot F/2=\sqrt{3}\cdot LF/2 \quad (6)$$

For example, the center of gravity 52g of the second balancer 52 is used as a reference point. The Y-direction component of the centrifugal force acting on the first balancer 51 due to rotation of the shaft 13 is assumed to be Fby. A moment of force Mbx acting on the shaft 13 around the X axis due to the Y-direction component Fby of the centrifugal force acting on the first balancer 51 is expressed by mathematical expression 7.

$$Mbx=B\cdot Fby \quad (7)$$

When the following mathematical expression 8 is established, the moment of force acting on the shaft 13 around the X axis is 0.

$$Mx+Mbx=0 \quad (8)$$

Fby satisfying mathematical expression 8 is expressed by mathematical expression 9.

$$Fby=-\sqrt{3}\cdot LF/2B \quad (9)$$

A mass, a position, and a shape of the first balancer 51 are set so that the Y-direction component Fby of the centrifugal force acting on the first balancer 51 satisfies mathematical expression 9.

A Y-direction component of the centrifugal force acting on the second balancer 52 due to rotation of the shaft 13 is −Fby. −Fby is expressed by mathematical expression 10.

$$-Fby=\sqrt{3}LF/2B \quad (10)$$

A mass, a position, and a shape of the second balancer 52 are set so that the Y-direction component Fby of the centrifugal force acting on the second balancer 52 satisfies mathematical expression 10.

Figure 5:
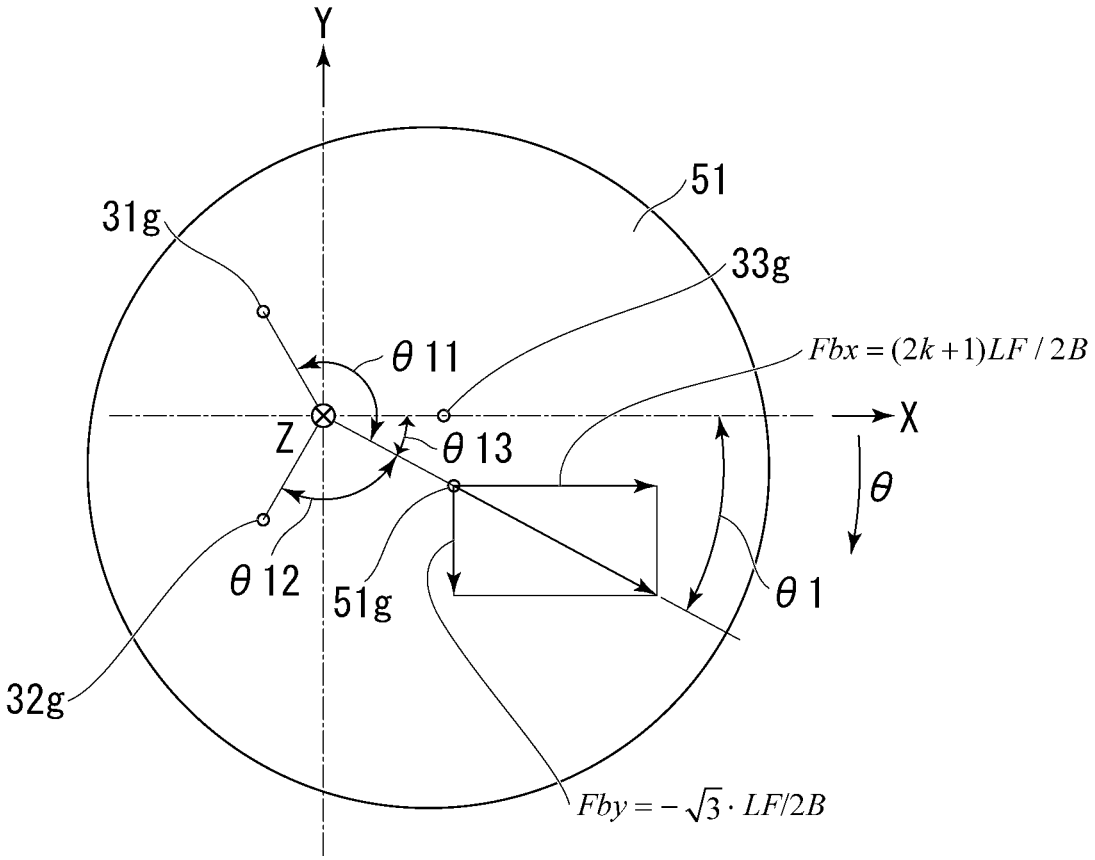
FIG. 5 is a bottom view of a first balancer.

FIG. 5 is a bottom view of the first balancer. As described above, the X-direction component Fbx of the centrifugal force acting on the first balancer 51, in which the moment of force acting on the shaft 13 is 0, is expressed by mathematical expression 4, and the Y-direction component Fby is expressed by mathematical expression 9. An angle θ1(rad) of a direction of eccentricity of the center of gravity 51g of the first balancer 51 from the central axis of the shaft 13 with respect to the +X direction in the θ direction is expressed by mathematical expression 11.

$$\theta1=\arctan(A),A=\sqrt{3}/(2k+1) \quad (11)$$

Angles between the direction of eccentricity of the center of gravity 51g of the first balancer 51 with respect to the central axis of the shaft 13 and directions of eccentricity of the centers of gravity of the plurality of eccentric parts 30 with respect to the central axis of the shaft 13 are defined as follows. The angle with respect to a direction of eccentricity of the center of gravity 31g of the first eccentric part 31 is θ11. The angle with respect to a direction of eccentricity of the center of gravity 32g of the second eccentric part 32 is θ12. The angle with respect to a direction of eccentricity of the center of gravity 33g of the third eccentric part 33 is θ13. The angles between the direction of eccentricity of the center of gravity 51g of the first balancer 51 with respect to the central axis of the shaft 13 and the directions of eccentricity of the centers of gravity of the plurality of eccentric parts 30 with respect to the central axis of the shaft 13 satisfy mathematical expression 12.

$$\theta13<\theta12<\theta11 \quad (12)$$

That is, the angle increases in an order of θ13, θ12, and θ11 from the smallest.

The plurality of eccentric parts 30 and the first balancer 51 are set to satisfy mathematical expression 12. Even when the directions of eccentricity of the plurality of eccentric parts 30 are not at equiangular intervals, the moment of force of the shaft 13 is suppressed when mathematical expression 12 is satisfied. Even when the centrifugal force acting on the first balancer 51 does not satisfy mathematical expression 4 or 9, the moment of force of the shaft 13 is suppressed when mathematical expression 12 is satisfied.

Figure 6:
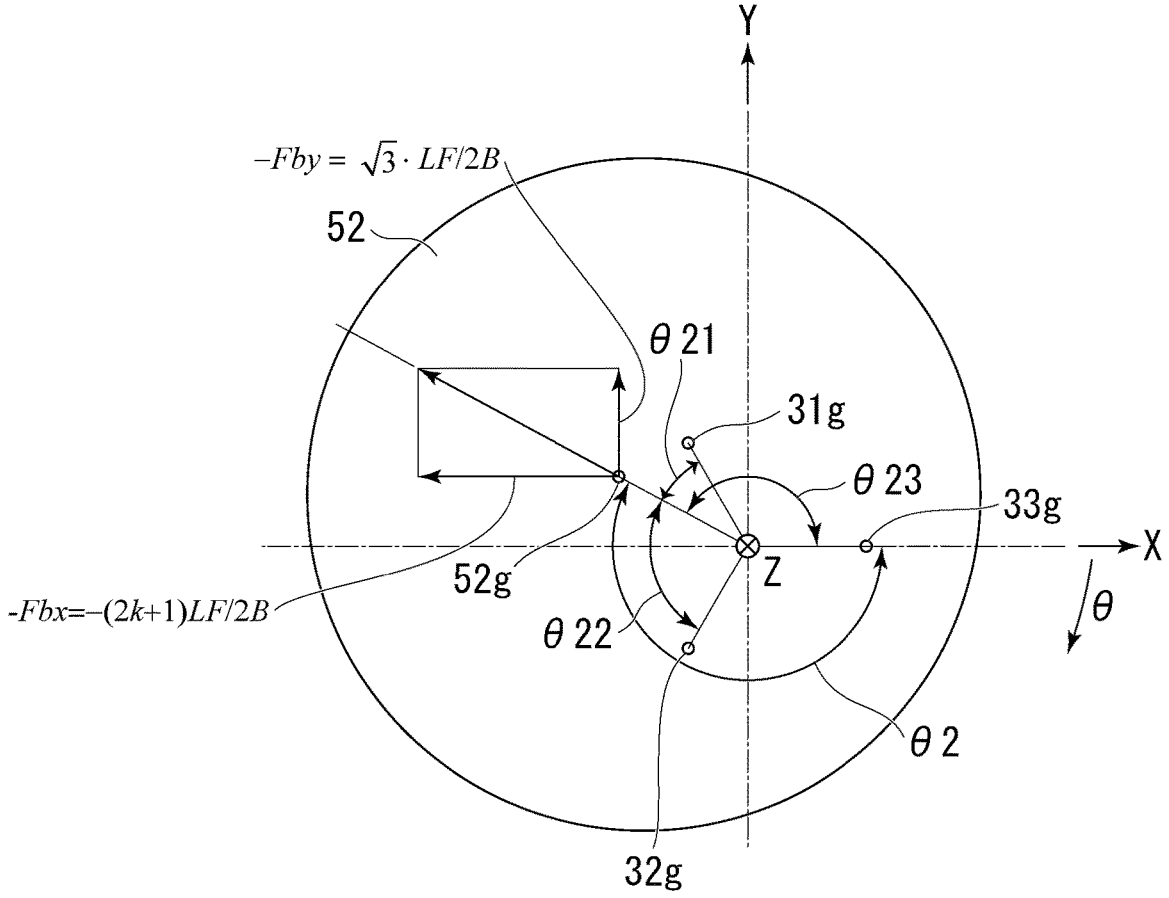
FIG. 6 is a bottom view of a second balancer.

FIG. 6 is a bottom view of the second balancer. As described above, the X-direction component −Fbx of the centrifugal force acting on the second balancer 52, in which the moment of force acting on the shaft 13 is 0, is expressed by mathematical expression 5, and the Y-direction component −Fby is expressed by mathematical expression 10. An angle θ2(rad) of a direction of eccentricity of the center of gravity 52g of the second balancer 52 from the central axis of the shaft 13 with respect to the +X direction in the 0 direction is expressed by mathematical expression 13.

$$\theta2=\arctan(A)+\pi,A=\sqrt{3}/(2k-1) \quad (13)$$

Angles between the direction of eccentricity of the center of gravity 52g of the second balancer 52 with respect to the central axis of the shaft 13 and the directions of eccentricity of the centers of gravity of the plurality of eccentric parts 30 with respect to the central axis of the shaft 13 are defined as follows. The angle with respect to the direction of eccentricity of the center of gravity 31g of the first eccentric part 31 is θ21. The angle with respect to the direction of eccentricity of the center of gravity 32g of the second eccentric part 32 is θ22. The angle with respect to the direction of eccentricity of the center of gravity 33g of the third eccentric part 33 is θ23. The angles between the direction of eccentricity of the center of gravity 52g of the second balancer 52 with respect to the central axis of the shaft 13 and the directions of eccentricity of the centers of gravity of the plurality of eccentric parts 30 with respect to the central axis of the shaft 13 satisfy mathematical expression 14.

$$\theta21<\theta22<\theta23 \quad (14)$$

That is, the angle increases in an order of θ21, θ22, and θ23 from the smallest.

The plurality of eccentric parts 30 and the second balancer 52 are set to satisfy mathematical expression 14. Even when the directions of eccentricity of the plurality of eccentric parts 30 are not at equiangular intervals, the moment of force of the shaft 13 is suppressed when mathematical expression 14 is satisfied. Even when the centrifugal force acting on the second balancer 52 does not satisfy mathematical expression 5 or 10, the moment of force of the shaft 13 is suppressed when mathematical expression 14 is satisfied.

Figure 7:
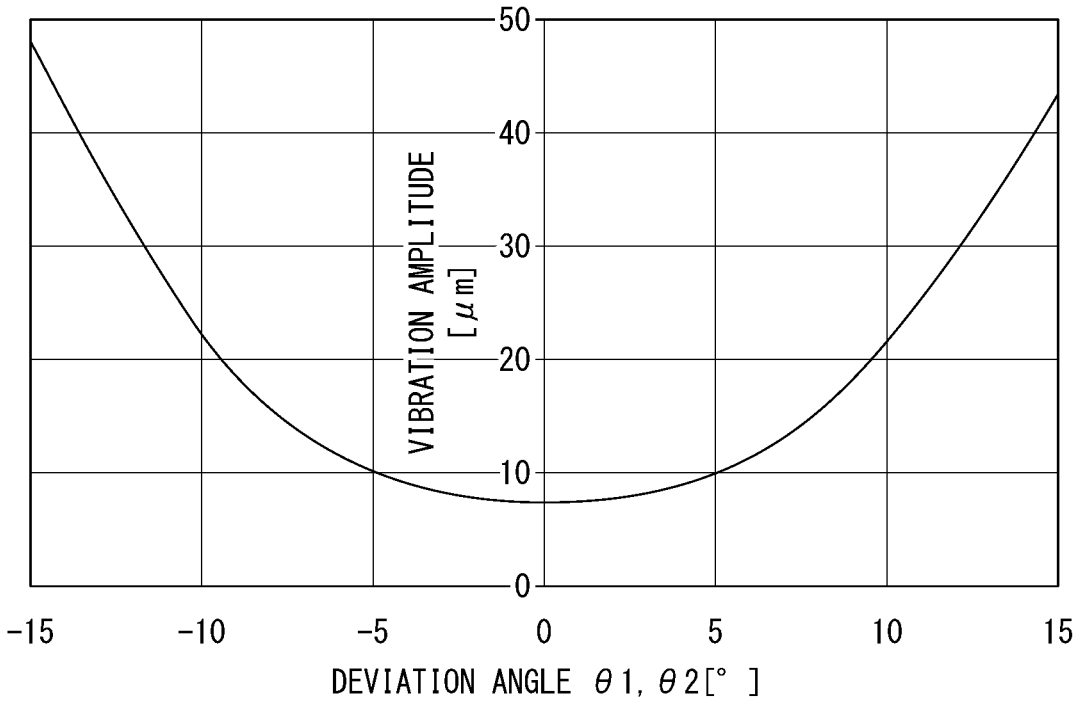
FIG. 7 is a graph illustrating a relationship between a deviation angle of the balancer and a vibration amplitude of a compressor main body.

FIG. 7 is a graph illustrating a relationship between a deviation angle of the balancer and a vibration amplitude of the compressor main body. The horizontal axis of FIG. 7 represents a deviation angle (°) of the angles θ1 and θ2 of the balancers 51 and 52 described above. The vertical axis of FIG. 7 is a vibration amplitude (μm) of the compressor main body 10. As the deviation angles of the angles θ1 and θ2 of the balancers 51 and 52 increase, the vibration amplitude of the compressor main body 10 becomes larger. When the deviation angles of the angles θ1 and θ2 are in a range of ±5° (±π/36 rad), the vibration amplitude of the compressor main body 10 is 10 μm or lower. It is desirable that the angles θ1 and θ2 satisfy mathematical expressions 15 and 16, respectively, with A=√3/(2k+1).

$$\arctan(A)-\pi/36 \leq \theta 1 \leq \arctan(A)+\pi/36 \quad (15)$$

$$\arctan(A)+\pi-\pi/36 \leq \theta 2 \leq \arctan(A)+\pi+\pi/36 \quad (16)$$

As described in detail above, the rotary compressor of the embodiment includes the shaft 13, the plurality of compression mechanism units 20, the plurality of eccentric parts 30, the first balancer 51, and the second balancer 52. The plurality of eccentric parts 30 include the first eccentric part 31, the second eccentric part 32, and the third eccentric part 33 disposed to be aligned from the +Z direction to the −Z direction in the central axis direction of the shaft 13. The second balancer 52 is disposed in the —Z direction of the first balancer 51. Angles between the direction of eccentricity of the first balancer 51 and the directions of eccentricity of the plurality of eccentric parts 30 satisfy mathematical expression 12. Angles between the direction of eccentricity of the second balancer 52 and the directions of eccentricity of the plurality of eccentric parts 30 satisfy mathematical expression 14.

In the three-cylinder rotary compressor 2, the moment of force of the shaft 13 caused by the three eccentric parts 31, 32, and 33 is suppressed by the two balancers 51 and 52. Thereby, vibration of the rotary compressor 2 is suppressed. Decrease in reliability and deterioration in performance of the rotary compressor 2 due to bending of the shaft 13 are suppressed. Therefore, the rotary compressor 2 having low vibration, high reliability, and high performance can be provided.

An angle in a direction of eccentricity of the first balancer 51 with respect to the +X direction is assumed to be θ1(rad). An angle in a direction of eccentricity of the second balancer 52 with respect to the +X direction is assumed to be θ2(rad). θ1 and θ2 satisfy mathematical expressions 15 and 16.

When θ1 satisfies mathematical expression 11 and θ2 satisfies mathematical expression 13, the moment of force of the shaft 13 is theoretically 0. When the deviation angle of θ1 from mathematical expression 11 and the deviation angle of θ2 from mathematical expression 13 are ±5°, the vibration amplitude of the compressor main body 10 is suppressed to 10 μm or lower. Therefore, when mathematical expressions 15 and 16 are satisfied, the rotary compressor 2 with low vibration can be provided.

The plurality of eccentric parts 30 are disposed between the first balancer 51 and the second balancer 52 in the Z direction.

The center of the moment of force acting on the shaft 13 due to the centrifugal force of the plurality of eccentric parts 30 and the center of the moment of force acting on the shaft 13 due to the centrifugal force of the two balancers 51 and 52 approach each other. Therefore, bending of the shaft 13 due to the deviation of the center of the moment of force is suppressed. Therefore, the rotary compressor 2 having low vibration, high reliability, and high performance can be provided.

Of the first region R1 between the center of gravity 31g of the first eccentric part 31 and the center of gravity 32g of the second eccentric part 32, and the second region R2 between the center of gravity 32g of the second eccentric part 32 and the center of gravity 33g of the third eccentric part 33, the intermediate bearing 45 that supports the shaft 13 is disposed in a region in which a distance in the Z direction is larger.

Since the intermediate bearing 45 is disposed near the center of the plurality of compression mechanism units 20, bending of the shaft 13 or the like is suppressed. Thereby, the rotary compressor 2 having low vibration, high reliability, and high performance can be provided.

The rotary compressor 2 further includes the electric motor unit 15, the first bearing 17, and the second bearing 18. The first balancer 51 is disposed in the +Z direction of the electric motor unit 15. The second balancer 52 is disposed in the −Z direction of the second bearing 18.

Since a distance between the balancers 51 and 52 is large, the mass of each of the balancers 51 and 52 is suppressed. Thereby, reduction in weight, reduction in size, and resource saving of the rotary compressor 2 can be achieved.

The refrigeration cycle device 1 of the embodiment includes the rotary compressor 2 described above, the radiator 3 connected to the rotary compressor 2, the expansion device 4 connected to the radiator 3, and the heat absorber 5 connected to the expansion device 4.

Thereby, the refrigeration cycle device 1 having low vibration, high reliability, and high performance can be provided.

Figure 8:
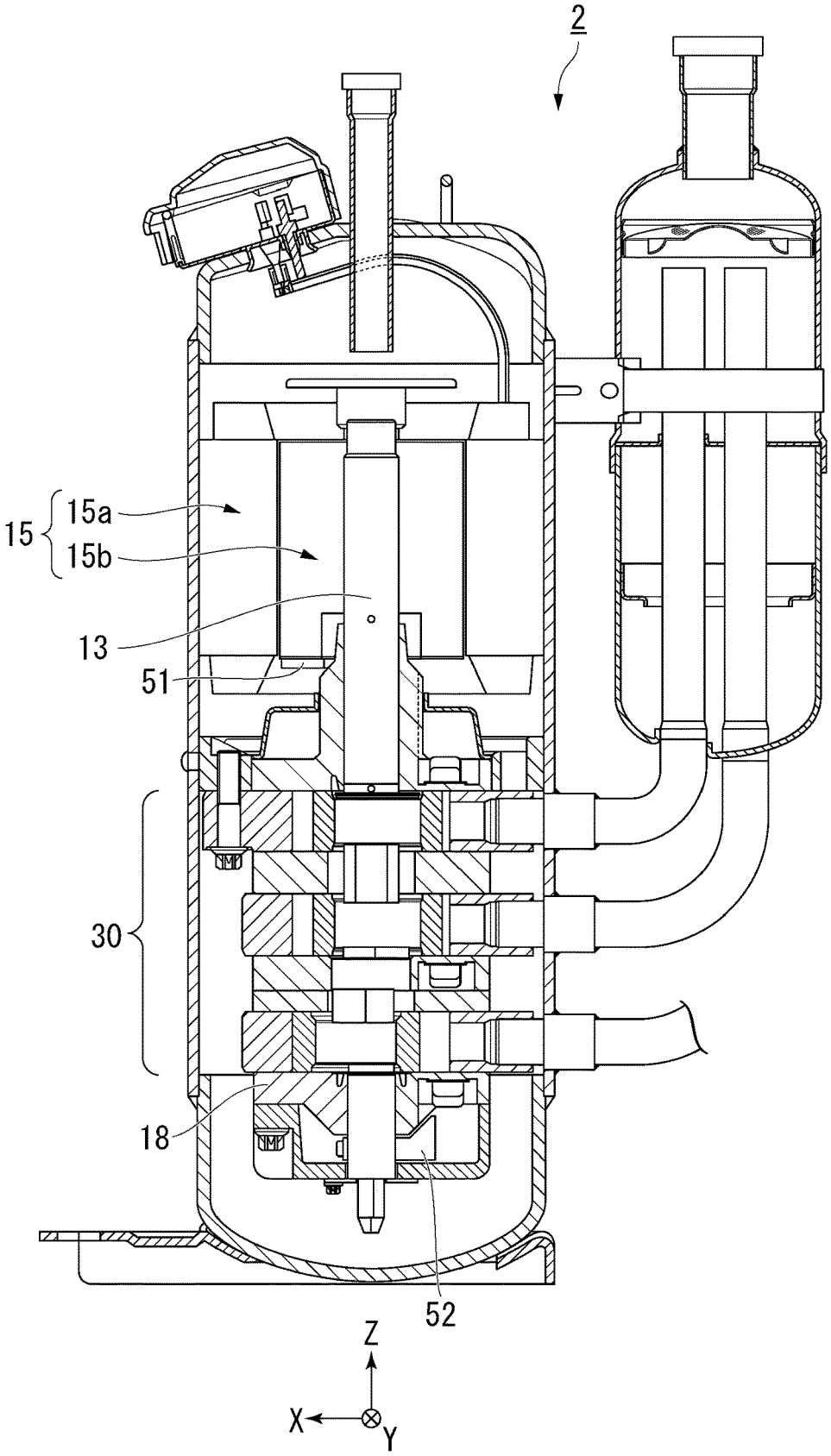
FIG. 8 is a cross-sectional view of a rotary compressor according to a first modified example of the embodiment.

FIG. 8 is a cross-sectional view of a rotary compressor of a first modified example of the embodiment. The first modified example is different from the embodiment in terms of positions and shapes of the balancers 51 and 52.

Similarly to the embodiment, the first balancer 51 and the second balancer 52 rotate together with the shaft 13. The second balancer 52 is disposed in the −Z direction of the first balancer 51. The plurality of eccentric parts 30 are disposed between the first balancer 51 and the second balancer 52 in the Z direction.

The first balancer 51 is disposed in the +Z direction of the plurality of eccentric parts 30. The first balancer 51 is disposed in the −Z direction of the electric motor unit 15. The first balancer 51 is fixed to an end surface of the rotor 15*b* of the electric motor unit 15 in the −Z direction.

The second balancer 52 is disposed in the −Z direction of the plurality of eccentric parts 30. The second balancer 52 is disposed in the −Z direction of the second bearing 18. A surface of the second balancer 52 in the +Z direction is disposed along a surface of the second bearing 18 in the −Z direction.

The rotary compressor 2 of the first modified example satisfies mathematical expressions 12, 14, 15, and 16. The plurality of eccentric parts 30 are disposed between the first balancer 51 and the second balancer 52 in the Z direction. Thereby, the rotary compressor 2 having low vibration, high reliability, and high performance can be provided.

Figure 9:
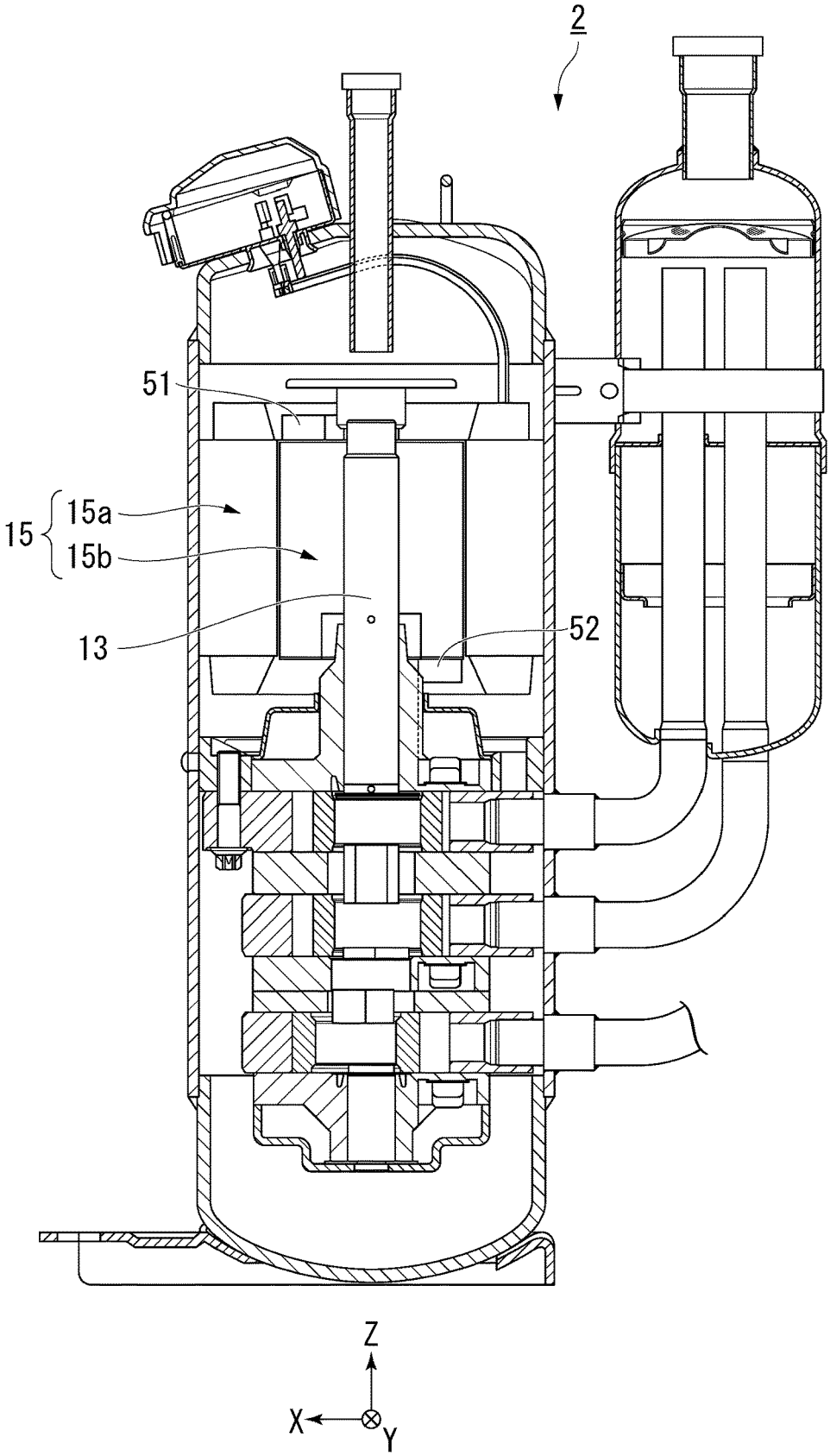
FIG. 9 is a cross-sectional view of a rotary compressor according to a second modified example of the embodiment.

FIG. 9 is a cross-sectional view of a rotary compressor of a second modified example of the embodiment. The second modified example is different from the embodiment in terms of positions and shapes of the balancers 51 and 52.

Similarly to the embodiment, the first balancer 51 and the second balancer 52 rotate together with the shaft 13. The second balancer 52 is disposed in the −Z direction of the first balancer 51.

The first balancer 51 is disposed in the +Z direction of the plurality of eccentric parts 30. The first balancer 51 is disposed in the +Z direction of the electric motor unit 15. The first balancer 51 is fixed to an end surface of the rotor 15*b* of the electric motor unit 15 in the +Z direction.

The second balancer 52 is disposed in the +Z direction of the plurality of eccentric parts 30. The second balancer 52 is disposed in the −Z direction of the electric motor unit 15. The second balancer 52 is fixed to an end surface of the rotor 15*b* of the electric motor unit 15 in the −Z direction.

The rotary compressor 2 of the second modified example satisfies mathematical expressions 12, 14, 15, and 16.

Thereby, the rotary compressor 2 having low vibration, high reliability, and high performance can be provided.

The rotary compressor 2 of the embodiment illustrated in FIG. 1 is a so-called rotary type compressor in which the blade (not illustrated) and the roller 35 are separate bodies. On the other hand, the rotary compressor may be a swing type compressor in which the blade and the roller are integrated.

According to at least one embodiment described above, the balancers 51 and 52 satisfying mathematical expressions 12 and 14 are provided. Thereby, the rotary compressor 2 having low vibration, high reliability, and high performance can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary compressor comprising:

a shaft rotatable around a central axis;

a plurality of compression mechanism units including a first compression mechanism unit, a second compression mechanism unit, and a third compression mechanism unit disposed to be aligned from one side to the other side in a central axis direction of the shaft;

a plurality of eccentric parts provided on the shaft and including a first eccentric part, a second eccentric part, and a third eccentric part corresponding to the first compression mechanism unit, the second compression mechanism unit, and the third compression mechanism unit;

a first balancer rotating together with the shaft; and a second balancer disposed on the other side of the first balancer and rotating together with the shaft, wherein angles between a direction of eccentricity of the first balancer with respect to the central axis of the shaft and directions of eccentricity of the plurality of eccentric parts with respect to the central axis of the shaft are configured to increase in an order of the third eccentric part, the second eccentric part, and the first eccentric part, and angles between a direction of eccentricity of the second balancer with respect to the central axis of the shaft and directions of eccentricity of the plurality of eccentric parts with respect to the central axis of the shaft are configured to increase in an order of the first eccentric part, the second eccentric part, and the third eccentric part.

2. The rotary compressor according to claim 1, wherein, when:

a ratio of a distance in the central axis direction between a center of gravity of the second eccentric part and a center of gravity of the third eccentric part to a distance in the central axis direction between a center of gravity of the first eccentric part and the center of gravity of the second eccentric part is k;

an angle between a direction of eccentricity of the third eccentric part with respect to the central axis of the shaft and the direction of eccentricity of the first balancer with respect to the central axis of the shaft is $\theta 1$(rad); and an angle between the direction of eccentricity of the third eccentric part with respect to the central axis of the shaft and the direction of eccentricity of the second balancer with respect to the central axis of the shaft is $\theta 2$(rad), $$\arctan(A)-\pi/36 \leq \theta 1 \leq \arctan(A)+\pi/36,$$

$$\arctan(A)+\pi-\pi/36 \leq \theta 2 \leq \arctan(A)+\pi+\pi/36, \text{ and}$$

$$A=\sqrt{3}/(2k+1)$$

are satisfied.

3. The rotary compressor according to claim 1, wherein the plurality of eccentric parts are disposed between the first balancer and the second balancer in the central axis direction.

4. The rotary compressor according to claim 1, wherein an intermediate bearing supporting the shaft is disposed in a region in which a distance in the central axis direction is larger between a first region between the center of gravity of the first eccentric part and the center of gravity of the second eccentric part and a second region between the center of gravity of the second eccentric part and the center of gravity of the third eccentric part.

5. The rotary compressor according to claim 1, further comprising:

an electric motor unit disposed on the one side of the plurality of compression mechanism units and rotationally driving the shaft;

a first bearing disposed on the one side of the plurality of compression mechanism units and supporting the shaft; and a second bearing disposed on the other side of the plurality of compression mechanism units and supporting the shaft, wherein the first balancer is disposed on the one side of the electric motor unit, and the second balancer is disposed on the other side of the second bearing.

6. A refrigeration cycle device comprising:

the rotary compressor according to claim 1;

a radiator connected to the rotary compressor;

an expansion device connected to the radiator; and a heat absorber connected to the expansion device.

* * * * *